US005340337A

United States Patent [19]

Pentz

[11] Patent Number: 5,340,337

[45] Date of Patent: Aug. 23, 1994

[54] PROTECTIVE SLEEVE FOR CANTILEVERED SPRING CONTACTS AND METHOD OF MAKING THE SAME

[75] Inventor: Edward L. Pentz, Greensboro, N.C.

[73] Assignee: The Whitaker Corporation, Wilmington, Del.

[21] Appl. No.: 73,013

[22] Filed: Jun. 4, 1993

[51] Int. Cl.[5] ..... H01R 13/187

[52] U.S. Cl. ..... 439/843; 439/885; 439/851

[58] Field of Search ..... 439/842, 843, 851, 833, 439/839, 856, 862, 825, 885

[56] References Cited

U.S. PATENT DOCUMENTS

| | | | |
|---|---|---|---|
| 3,003,135 | 10/1961 | Purinton | 439/843 |
| 4,009,924 | 3/1977 | Bungo et al. | 339/223 S |
| 4,148,547 | 4/1979 | Otsuki et al. | 439/843 |
| 4,168,878 | 9/1979 | Risser et al. | 339/217 S |
| 4,278,317 | 7/1981 | Galluser et al. | 439/843 |
| 4,412,718 | 11/1983 | Pfister | 339/256 R |
| 4,540,234 | 9/1985 | Konnemann et al. | 339/259 R |
| 4,550,972 | 11/1985 | Romak | 339/256 R |
| 4,934,964 | 6/1990 | Mazelle | 439/843 |
| 4,938,720 | 7/1990 | Romak | 439/839 |
| 4,944,701 | 7/1990 | Spinner | 439/825 |
| 5,156,555 | 10/1992 | Mohs et al. | 439/161 |
| 5,186,663 | 2/1993 | Wymelenberg | 439/843 |

FOREIGN PATENT DOCUMENTS

| | | | |
|---|---|---|---|
| 2621745 | 4/1989 | France | 439/851 |

*Primary Examiner*—David L. Pirlot
*Attorney, Agent, or Firm*—Bruce J. Wolstoncroft

[57] ABSTRACT

A protective sleeve (100) for a pair of cantilevered spring contacts (15, 16) is formed by a blanking, forming and bending process (rather than a deep-drawn process) thereby providing a superior product at less cost. During the blanking process, a hole (104) is pierced within a transverse end wall (103) formed between respective first and second sleeve portions (101, 102). These sleeve portions (101, 102) are bent into semi-cylindrical shapes and are then bent towards each other and at right angles to the wall (103) to form the cylindrical sleeve (100). The hole (104) is sized to accommodate a given pin (20) but prevents an oversized pin (20') from being inserted therethrough, thereby preventing inadvertent damage to the contacts (15, 16) or to the sleeve (100).

In an alternate embodiment, a barrel (107) is formed on a sleeve (100') rearwardly of the respective sleeve portions (101, 102), and the barrel (107) has a pair of lanced-out outwardly-extending ears (108, 109) received in an opening (11) on a contact assembly (13), thereby mounting the sleeve (100') on the contact (13). The sleeve 100' is also crimped on to a second diametrically-opposite opening (12) on the contact (13).

9 Claims, 5 Drawing Sheets

PROTECTIVE SLEEVE FOR CANTILEVERED SPRING CONTACTS AND METHOD OF MAKING THE SAME

FIELD OF THE INVENTION

The present invention relates to electrical contacts and/or terminals, including a male contact pin adapted to be received between a pair of cantilevered female spring contacts, and more particularly, to a protective sleeve for the contacts and a method of making the sleeve.

BACKGROUND OF THE INVENTION

Contact pins and cantilevered spring contacts are widely used in various electrical and electronic products. Typically, the pair of cantilevered spring contacts are formed integrally with a barrel, rearwardly of the contacts, and the barrel is crimped about the bare portion of an insulated wire for electrical engagement with the contacts. The contacts, in turn, slidably receive the pin.

A plurality of closely-spaced pins are usually mounted on a plug and are adapted to engage a corresponding plurality of closely-spaced contacts in a receptacle or header. For example, the header may be mounted within a piece of electrical or electronic equipment, and the plug may be mounted on the end of a cable carried by another assembly.

In certain product applications, the contacts in the header are often exposed; and in order to protect the contacts, a protective sleeve may be provided. This protective sleeve is substantially cylindrical, surrounds and encloses the contacts, and is crimped on to a rear portion of the contacts.

The contacts may be made of aluminum or a tin-based alloy, for example, and if desired may be plated with a precious or semi-precious metal for superior conductivity. The sleeve, in turn, may be made of copper or any suitable material that is readily available and relatively inexpensive. Presently, the sleeve is made by a deep drawing process.

However, because of the continuous evolution in product miniaturization involving relatively-high circuit densities, it is difficult to form the sleeve by a deep drawing process and to handle the relatively small pieces involved. For example, the sleeve may have an outer diameter of roughly two or three millimeters.

Besides, there is no way to preclude an oversized pin from being inserted through the sleeve and between the contacts, thereby inadvertently damaging the contacts. This problem is especially pronounced where several cables and headers are available to an inexperienced non-technical person assembling or using the equipment.

SUMMARY OF THE INVENTION

Accordingly, it is an object of the present invention to provide a unique method of forming the protective sleeve and, simultaneously, forming the sleeve in such a manner as to prevent an oversized pin from being inserted, albeit inadvertently, between the contacts.

In accordance with the teachings of the present invention, the improved method of forming the protective cylindrical sleeve includes the steps of providing a sheet of planar material and blanking out the plan outline of the sleeve from the sheet. As a result, a first sleeve portion, a second sleeve portion, and a wall portion are formed. The wall portion is disposed between the first and second sleeve portions and is pierced to form a hole therein. Each of the first and second sleeve portions is bent into a semi-cylindrical form; and the first and second semi-cylindrical sleeve portions are then bent towards each other to form the cylindrical sleeve. The wall portion is at right angles to the cylindrical sleeve, and the hole in the wall portion accommodates the outer diameter of the given pin.

The hole is only slightly larger than the outer diameter of the pin, such that the hole accommodates the pin but prevents an oversized pin from being inserted between the contacts, thereby protecting the contacts from inadvertent damage.

In an alternate embodiment, a cylindrical barrel is formed integrally with the cylindrical sleeve, rearwardly thereof, and a tab on the sleeve extends rearwardly thereof and is received within the barrel. The barrel, in turn, has a pair of lanced-out spring ears extending outwardly therefrom; and the ears are received within an opening formed in the contact, thereby mounting the sleeve on the contact.

These and other objects of the present invention will become apparent from a reading of the following specification taken in conjunction with the enclosed drawings.

BRIEF DESCRIPTION OF THE DRAWINGS

FIG. 2 is a plan outline of a sleeve blank punched out of a suitable material, thereby forming a wall between a pair of respective sleeve portions, in accordance with the improved method of the present invention.

FIG. 3 is a plan outline of the sleeve blank, showing a hole pierced in the wall.

FIG. 4 is a perspective view showing the respective sleeve portions bent into substantially semi-cylindrical sleeve portions.

FIG. 5 shows the respective semi-cylindrical sleeve portions being bent towards each other, thereby forming the cylindrical sleeve with a transverse wall at one end (the forward end) of the sleeve, the wall having a hole sized to the outer diameter of a given pin.

GENERAL DESCRIPTION OF THE PREFERRED EMBODIMENTS

A deep-drawn protective sleeve, used in the prior art, generally has respective portions crimped within a pair of diametrically-opposite openings formed in a contact. The contacts are formed by a stamping process and include a carrier strip which is subsequently removed. The contacts include a pair of cantilevered spring contacts projecting forwardly thereof. A bare portion of an insulated wire is connected to the contact by a barrel crimp. A pin is slidably inserted between the contacts.

In the event an oversized pin is inadvertently forced into the sleeve, the sleeve and the contacts will be damaged. Moreover, with product miniaturization, the protective sleeves have become quite small, having a outer diameter of around two or three millimeters; and it has become increasingly difficult (and expensive) to form the sleeves by a conventional deep-drawing process, yet maintain product quality.

Figure 1:
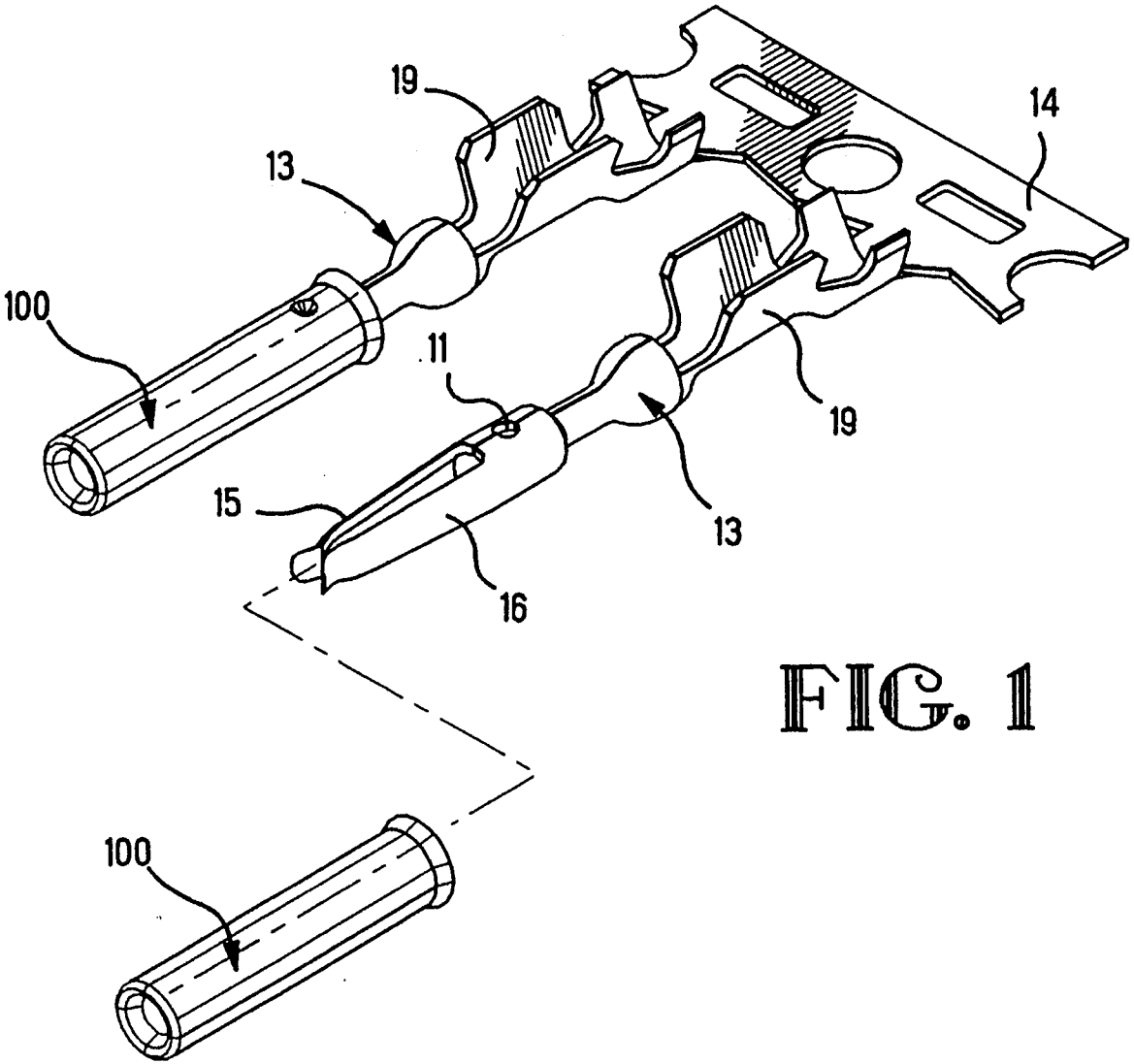
FIG. 1 is a perspective view of the invention, including a pair of cantilevered spring contacts and the carrier strip, and showing one of the sleeves in exploded relationship thereto.

With reference to FIG. 1, a sleeve 100 of the present invention is provided for use with contacts 13. The contacts are stamped and formed and include a carrier strip 14 which is subsequently removed. The contacts 13 include a pair of cantilevered spring contacts 15 and 16, respectively, projecting forwardly thereof. A wire (not shown) is connected to the contact 13 by a barrel crimp 19.

Figure 2:
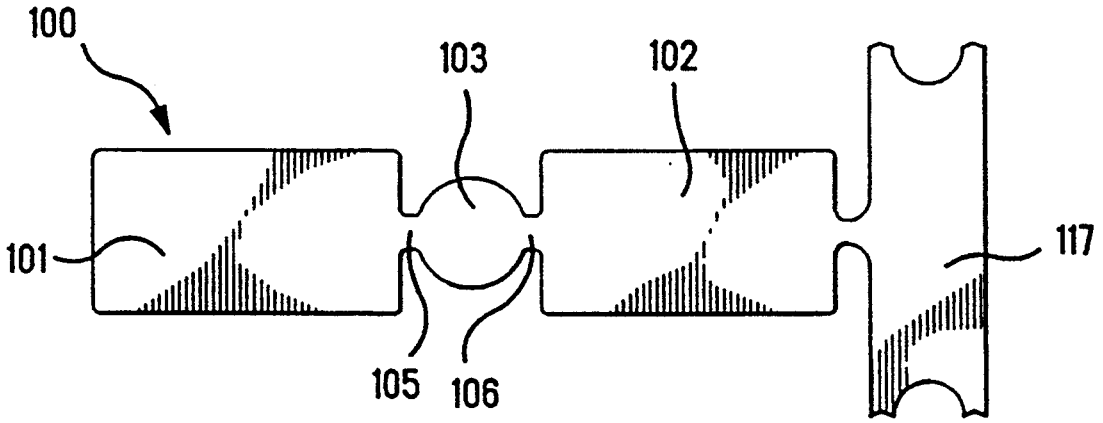
FIGS. 2–5 show the sequence of forming the protective sleeve of the present invention by a blanking and stamping process, rather than the antiquated deep-drawn process heretofore resorted to in the prior art.
Figure 3:
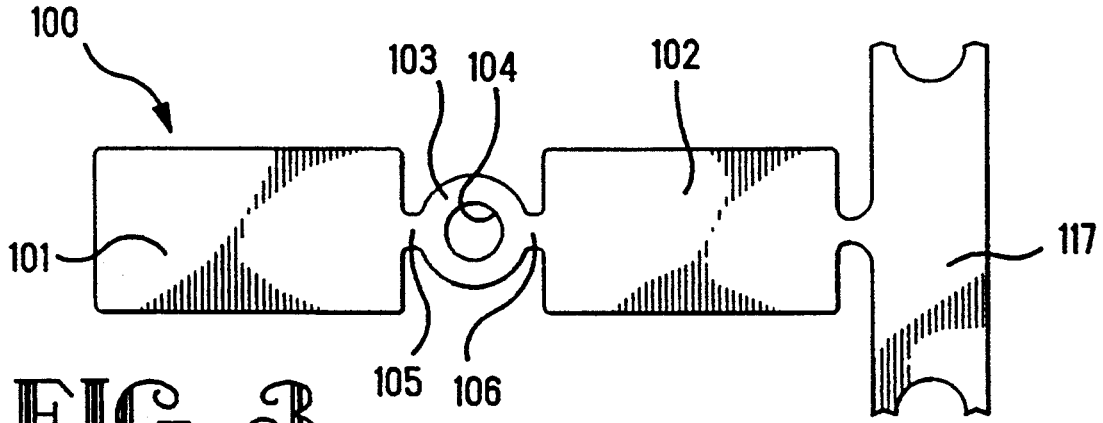
Figure 4:
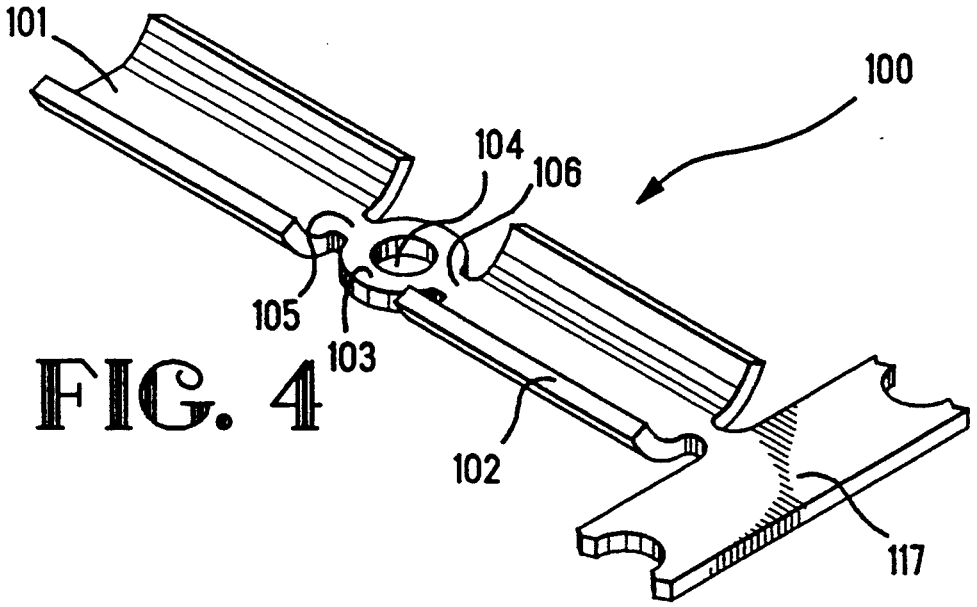
Figure 5:
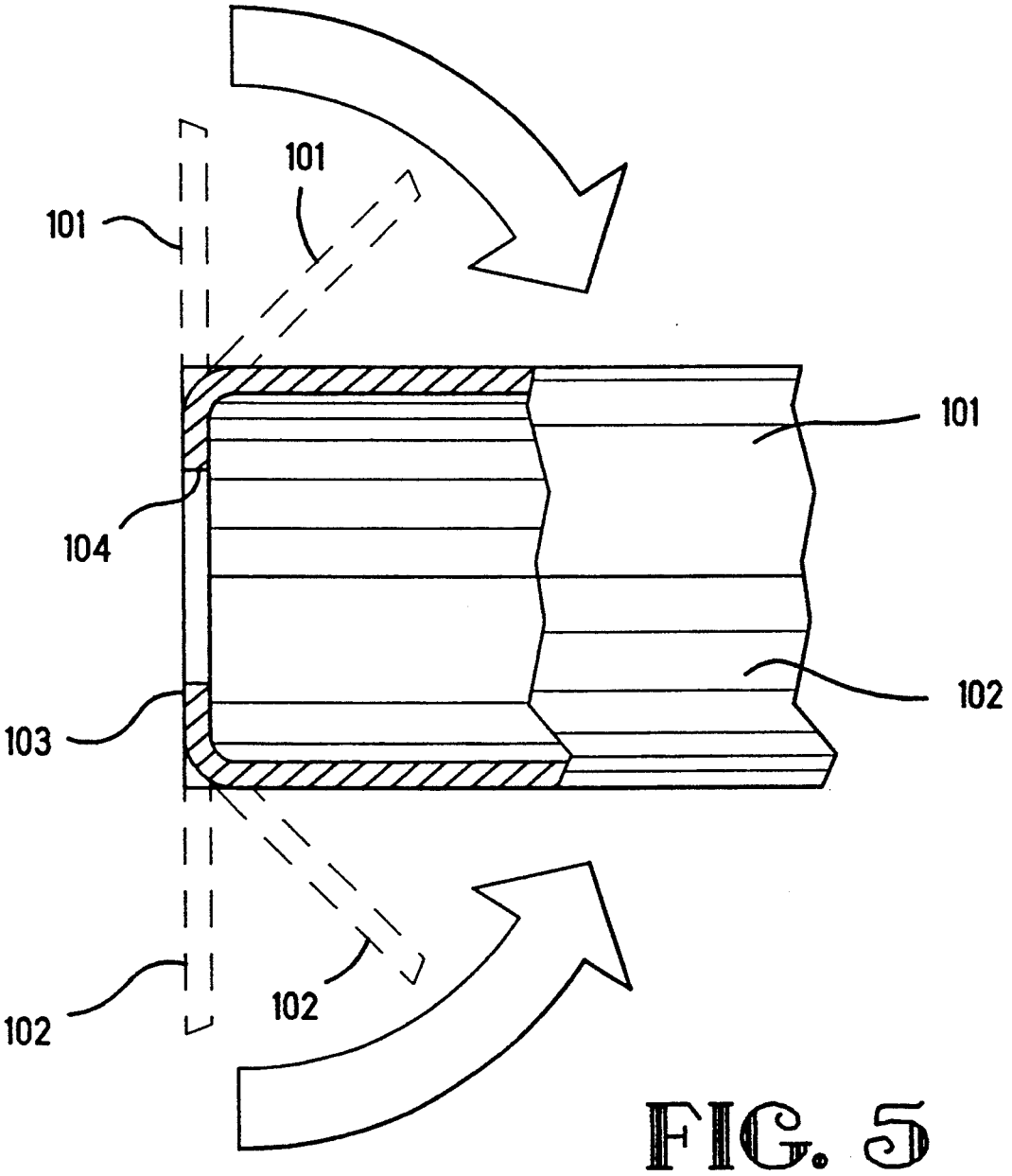

In accordance with the teachings of the present invention, and as shown in FIGS. 2–5, a sleeve 100 is blanked out in a single step (or progressively if desired) to form the plan outline shown in FIG. 2. The plan outline of the sleeve 100 includes a first sleeve portion 101 and a second sleeve portion 102 having a wall portion 103 therebetween. The wall portion 103 is substantially circular and has a hole 104 pierced therein (FIG. 3). The wall 103 is integrally connected to the first sleeve portion 101 and to the second sleeve portion by bridges 105 and 106 respectively, as shown in FIG. 3. The first and second sleeve portions 101 and 102, respectively, are each bent into substantially semi-cylindrical forms (FIG. 4) and are bent towards each other and into a position substantially at right angles to the wall 103 (FIG. 5) to form the completed sleeve 100.

The material of the sleeve 100 is sufficiently rigid, especially after being formed and bent, so that it is not necessary to physically join the respective first and second sleeve portions 101 and 102 to each other (as by seam welding or a spot welding) thereby saving additional costs in the manufacturing process. During the forming and bending steps, the bridges 105 and 106, respectively, alleviate internal stresses and obviate any tendency to develop cracks between the wall 103 and the first and second sleeve portions 101 and 102, respectively. The sleeves 100 may be formed from a continuous coil or band of material (not shown) having a carrier strip 117. This carrier strip 117 will be ultimately removed from the sleeve 100. The material for the sleeve 100 may be relatively-thin copper or cold-rolled steel or whatever suitable material is readily available and is relatively inexpensive, since electrical or thermal conductivity of the sleeve 100 is not an important criterion.

Figure 6:
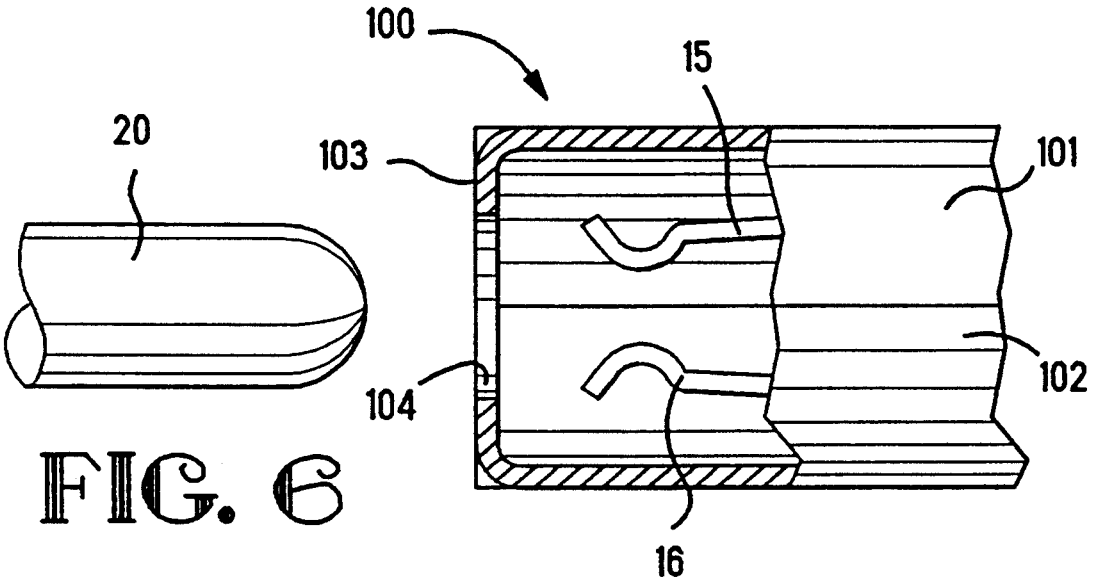
FIG. 6 is a top plan view of the protective sleeve of the present invention, broken away and sectioned to show the pair of cantilevered spring contacts, and further showing the pin in exploded relationship thereto.
Figure 7:
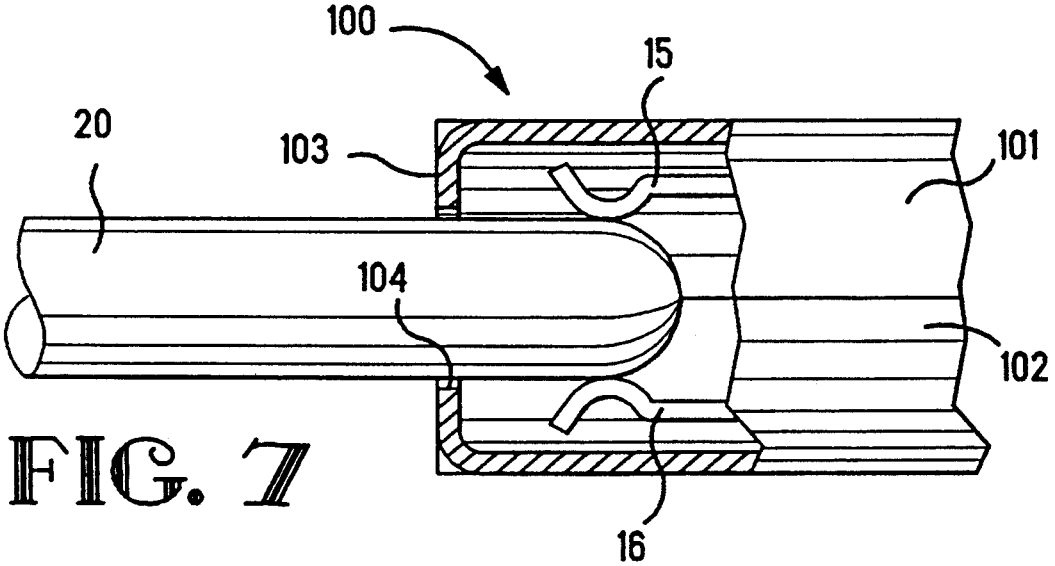
FIG. 7 is a further top plan view, corresponding substantially to FIG. 6, but showing the pin slidably inserted through the hole formed in the transverse wall on the end of the sleeve, thereby engaging the contacts.

With reference to FIGS. 6 and 7, the pin 20 is slidably received through the hole 104 formed in the wall 103 of the sleeve 100. The diameter of the hole 104 is slightly larger than the outer diameter of the pin 20, and the pin 20 is received between the spring contacts 15 and 16, respectively.

Figure 8:
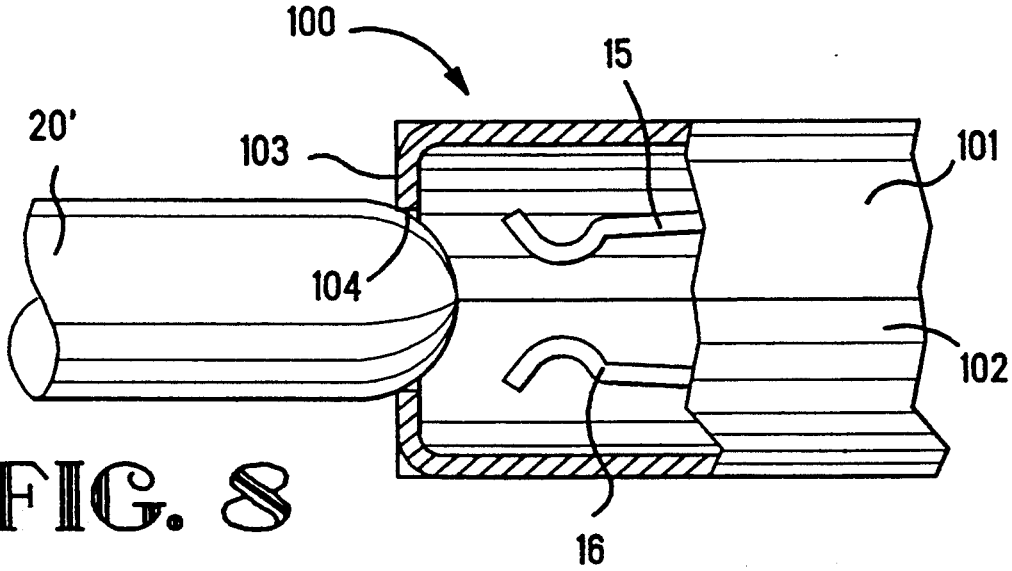
FIG. 8 is a still further top plan view, corresponding substantially to FIG. 7, but showing how an oversized pin is prevented from being inserted into the sleeve, thereby protecting the contacts against inadvertent damage.
Figure 9:
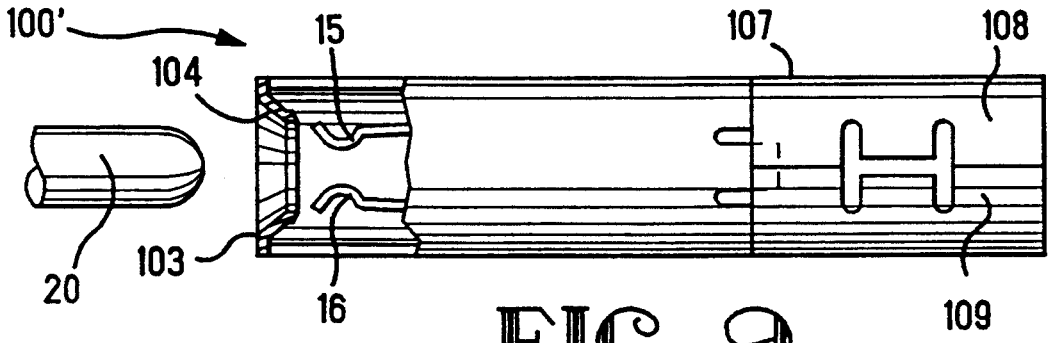
FIG. 9 is top plan view, with certain parts broken away and sectioned, to show the alternate embodiment.
Figure 10:
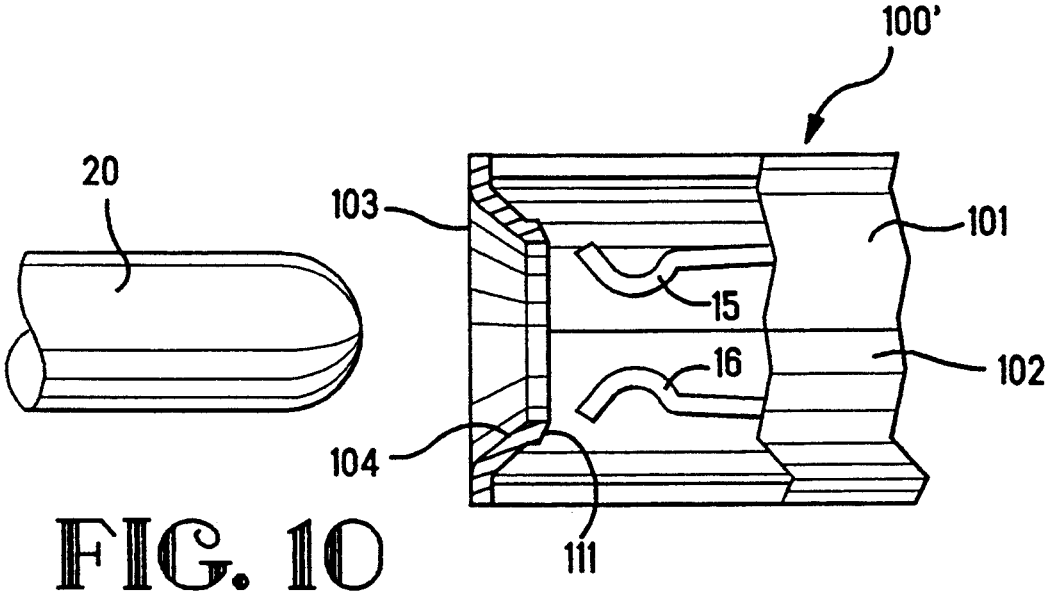
FIG. 10 is a portion of FIG. 9, drawn to an enlarged scale, and showing the annular dimple on the hole in the transverse wall in the sleeve, the pin being shown in exploded relationship thereto.

With reference to FIG. 8, the oversized pin 20' cannot fit through the hole 104 in the wall 103 of the sleeve 100, thereby preventing inadvertent damage to the sleeve 100 and, especially, to the contacts 15 and 16.

Figure 11:
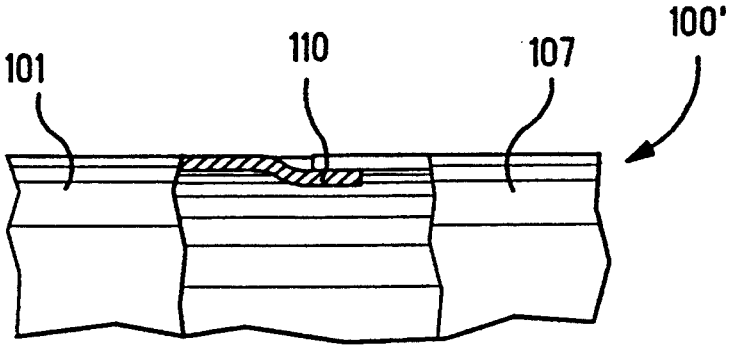
FIG. 11 is a enlarged portion of FIG. 9, showing the tab on the sleeve received within the barrel, thereby improving the structural rigidity of the assembly.

It is worth noting that the sleeve 100' may be formed with an integral barrel portion 107. As shown in FIG. 8, this barrel portion 107 has a pair of lanced-out outwardly-extending ears 108 and 109, respectively. As the respective sleeve portions 101 and 102 are bent into semi-cylindrical shapes (as in FIGS. 2–5) the barrel portion 107 is also bent into a cylindrical shape; and a tab 110 on the first sleeve portion 101 is received within the cylindrical barrel portion 107 (FIG. 11) thereby improving the structural integrity of the overall assembly.

With reference to FIGS. 16 and 19, the respective lanced-out ears 108 and 109 are received within the opening 11 in the contact 13; and the sleeve 100' is crimped into the diametrically-opposite opening 12, thereby retaining the sleeve 100' on the contact 13.

With further reference to FIG. 17, the hole 104 in the wall 103 of the sleeve 100' has an annular relief or dimple 111, thereby facilitating the slidable insertion of the pin 20 and preventing the plating on the pin 20 from being inadvertently scraped off the pin 20.

Obviously, many modifications may be made without departing from the basic spirit of the present invention. For example, the disclosed sequence in making the sleeves 100 and 100', respectively, may be re-arranged to suit particular manufacturing processes, if desired. Accordingly, it will be appreciated by those skilled in the art that within the scope of the appended claims, the invention may be practiced other than has been specifically described herein.

I claim:

1. In an electrical contact including a pair of cantilevered spring contacts, wherein a pin is slidably received between the spring contacts, and wherein the pin has an outer diameter, the improvement comprising the contact has an opening formed thereon rearwardly of the pair of spring contacts, a protective sleeve for the spring contacts has a hollow main body having respective end portions, the hollow main body has a lanced-out inwardly-extending ear formed thereon, the ear being received within the opening in the contact to mount the sleeve to the contact, a wall formed integrally with one of the end portions of the hollow main body, transversely thereof, the wall having a hole formed therein for receiving the pin, and the hole being only slightly larger than the outer diameter of the pin, such that the hole accommodates the pin but prevents an oversized pin from being inserted between the spring contacts, thereby protecting the spring contacts from inadvertent damage.

2. The improvement of claim 1, wherein the hollow main body comprises a cylindrical sleeve.

3. The improvement of claim 2, further including a cylindrical barrel formed integrally with the other end portion of the cylindrical sleeve, and a tab formed integrally with the cylindrical sleeve and extending rearwardly therefrom and within the barrel, thereby improving the structural rigidity of the sleeve.

4. The improvement of claim 3, wherein the sleeve is crimped on to the other opening in the contact, thereby further mounting the sleeve on the contact.

5. The method of forming a protective cylindrical sleeve for a pair of electrical contacts receiving a pin therebetween, comprising the steps of providing a sheet of planar material, blanking out the plan outline of the sleeve from the sheet, thereby forming a first sleeve portion, a second sleeve portion, and a wall portion between the first and second sleeve portions, respectively, piercing the wall portion to form a hole therein, bending each of the first and second sleeve portions into a semi-cylindrical shape, bending the first and second semi-cylindrical sleeve portions, respectively, towards each other to form a cylindrical sleeve, such that the wall portion is at right angles to the cylindrical sleeve, such that the hole in the wall portion accommodates the outer diameter of the pin to be inserted therethrough and between the contacts, and such that an oversized pin cannot be inserted into the cylindrical sleeve.

6. The method of claim 5, further including the steps of blanking out a barrel rearwardly of the cylindrical sleeve, and bending the barrel into a cylindrical shape.

7. The method of claim 6, further including the steps of providing a tab on one of the sleeve portions, and positioning the tab within the barrel.

8. The method of claim 6, further including the steps of providing a contact having at least one opening rearwardly of the pair of spring contacts, lancing-out a pair of outwardly-extending ears on the barrel, and pushing the ears into the opening in the contact, thereby mounting the sleeve on the contact.

9. The method of claim 8, further including the steps of providing a second opening on the contact, diametrically opposite to the at least one opening, and crimping a portion of the sleeve into the second opening, thereby further mounting the sleeve on the contact.

* * * * *